US005180125A

United States Patent [19]

Caveney

[11] Patent Number: 5,180,125

[45] Date of Patent: Jan. 19, 1993

[54] APPARATUS FOR LOADING A TRASH BAG WITH DEBRIS FROM THE GROUND

[76] Inventor: Robert D. Caveney, 18396 Knuth Rd., Los Gatos, Calif. 95030

[21] Appl. No.: 563,110

[22] Filed: Aug. 6, 1990

[51] Int. Cl.[5] ..... A47L 13/52

[52] U.S. Cl. ..... 248/99; 15/257.1; 141/314; 248/95

[58] Field of Search ..... 248/99, 95, 314; 141/316; 383/33; 15/257.1, 257.2, 257.4, 347; 294/55; 56/202

[56] References Cited

U.S. PATENT DOCUMENTS

| | | | |
|---|---|---|---|
| 2,037,394 | 4/1936 | Rubin | 383/33 X |
| 2,731,184 | 1/1956 | Thurber | 248/99 X |
| 2,796,309 | 6/1957 | Taylor | 248/95 X |
| 3,618,157 | 11/1971 | Bassin | 56/202 X |
| 3,627,368 | 12/1971 | Baughman | 15/257.1 X |
| 3,777,461 | 12/1973 | Giraud | 56/202 |
| 3,816,986 | 6/1974 | Van Der Gaast | 56/202 |
| 3,817,448 | 6/1974 | Schneider | 248/99 X |
| 4,030,273 | 6/1977 | Leader | 56/202 X |
| 4,052,764 | 10/1977 | Groff | 15/257.9 |
| 4,268,081 | 5/1981 | Hawkinson | 294/55 |
| 4,318,521 | 3/1982 | Martin et al. | 248/95 X |
| 4,357,728 | 11/1982 | Pravettone | 15/257.4 |
| 4,366,916 | 1/1983 | Guido et al. | 220/404 |
| 4,440,430 | 4/1984 | Kruse | 248/95 X |
| 4,521,043 | 6/1985 | Wilsford | 15/257.4 X |
| 4,530,533 | 7/1985 | Dieter | 294/1.1 |
| 4,659,045 | 4/1987 | Flynn | 248/99 |
| 4,665,684 | 5/1987 | DiPaolo | 56/202 |
| 4,760,982 | 8/1988 | Cooke | 248/99 |
| 4,884,603 | 12/1989 | Simpson | 141/390 |
| 4,890,652 | 1/1990 | Hoerner | 141/10 |
| 4,951,903 | 8/1990 | Frey | 248/99 |
| 5,031,277 | 7/1991 | Coker | 15/257.1 X |

*Primary Examiner*—Carl D. Friedman
*Assistant Examiner*—Derek J. Berger

[57] ABSTRACT

A device for loading bags with material from the ground. The material can be garden trash, industrial waste or industrial material. The bags to be filled can be disposable or reusable. A container 74 with an open top 78 and with legs 88 attached on the inside and sticking out the top 78 of the container 74. A bag is fitted over the legs 88 and around the top 78 of the container 74, such that the bag is exterior to the container 74. The container 74 has opening in its sides so that when the container 74 is laid with one side 80 on the ground material can be raked or otherwise moved through the side openings into the container 74. A full container 74 is then tilted up on its legs 88 and the material slides into the bag. The device can also be used as a standard bag lined trash container. A full bag can be removed from the container through the openings in its sides rather than having to lift the full bag up through the top 78.

6 Claims, 9 Drawing Sheets

APPARATUS FOR LOADING A TRASH BAG WITH DEBRIS FROM THE GROUND

BACKGROUND OF THE INVENTION

Lawn, garden, and industrial pickup has traditionally been done by raking and sweeping the debris in piles and then using some manual means to move the debris into a trash container or plastic bag. The pertinent prior art known to the applicant at the present time includes the following patents:

REFERENCES CITED
U.S. PATENT DOCUMENTS

| U.S. PAT. NUMBER | ISSUE DATE | INVENTOR | CLASS |
|---|---|---|---|
| 3,638,888 | 2/1972 | Ross | 248/97 |
| 4,269,441 | 5/1981 | Hirsch | 294/1 R |
| 4,299,365 | 11/1981 | Battle | 248/99 |
| 4,664,348 | 5/1987 | Corsaut III et al | 248/99 |
| 4,757,966 | 7/1988 | Harris | 248/97 |
| 4,759,519 | 7/1988 | Cheng | 248/99 |
| 4,832,291 | 5/1989 | Nelson et al | 248/99 |
| 4,832,292 | 5/1989 | Beckham | 248/99 |

DISCUSSION OF PRIOR ART

U.S. Pat. No. 3,638,888 holds the mouth of the bag open and has an external wire frame that can be tilted up to drop material into the bag.

U.S. Pat. No. 4,299,365 has an internal wire frame which would tend to snag on debris as the frame is pulled from the bag.

U.S. Pat. No. 4,729,519 holds the mouth of the bag open, a stand to keep the bag mouth vertical and has an entrance ramp which is hinged and can act as a lid.

U.S. Pat. No. 4,832,292 holds the mouth of the bag open and has a an entrance lip which can act as a stand.

All the other patents cited are simple devices, some with handles, which keep the mouth of the bag open.

All the cited patents lack the features of the present invention; these added features make the invention truly unique and superior in performance over the prior art.

OBJECTS OF THE INVENTION

The objects of the invention are as follows:

1. To drastically reduce the time required to manually fill a trash bag with debris from the ground.

2. To reduce the amount of human energy and strength required to fill a trash bag with debris.

3. To combine the above two objectives into a device which can also be used as a standard bag-lined trash container.

4. To reduce the amount of human energy and strength required to remove a full bag from the bag-lined trash container.

ADVANTAGEOUS OF THE INVENTION

1. The bag can be filled in only one collection (raking, sweeping,) and one lift operation.

2. Very little strength and energy is required to fill the bag because of the following three reasons. The debris is lifted with a mechanical advantage because only one end is being lifted (In operation the device pivots on its legs and the debris slides into the bag). The mouth of the bag is lower—approximately 21.5 inches verses 27.5 inches for a typical trash can. And lastly, the debris put in the bag as part of the raking process doesn't have to be lifted.

3. The operator does not have to stoop and bend nearly as much as with any conventional manual method of filling the bag—because it can be filled in just one lifting operation.

4. The operation is quick. The bag is filled partially as part of the collection process; the lifting operation to fill the remainder of the bag takes less than 20 seconds.

5. No moveable clamps or attachments are needed to hold the bag onto the device. The operator only has to slip the bag over the invention. The design of the device keeps the bag in place until it is ready to be removed, at which time the removal is easy since no mechanism has to be unfastened.

6. The sides of the invention act as a backstage so that debris can be directed briskly into the invention and it stays where it is intended. This is different than raking leaves or grass into piles—if you put too much energy into the raking it just scatters the debris.

7. The device is multipurpose, when it is not being used to fill bags it can be used as a bag-lined trash container.

8. When the device is used as a trash container the full bag does not have to be lifted out of the trash bag because the bag is removed through the sides.

BRIEF DESCRIPTION OF DRAWINGS

In the drawings closely related figures have the same drawing number but different alphabetic suffixes.

Figure 2:
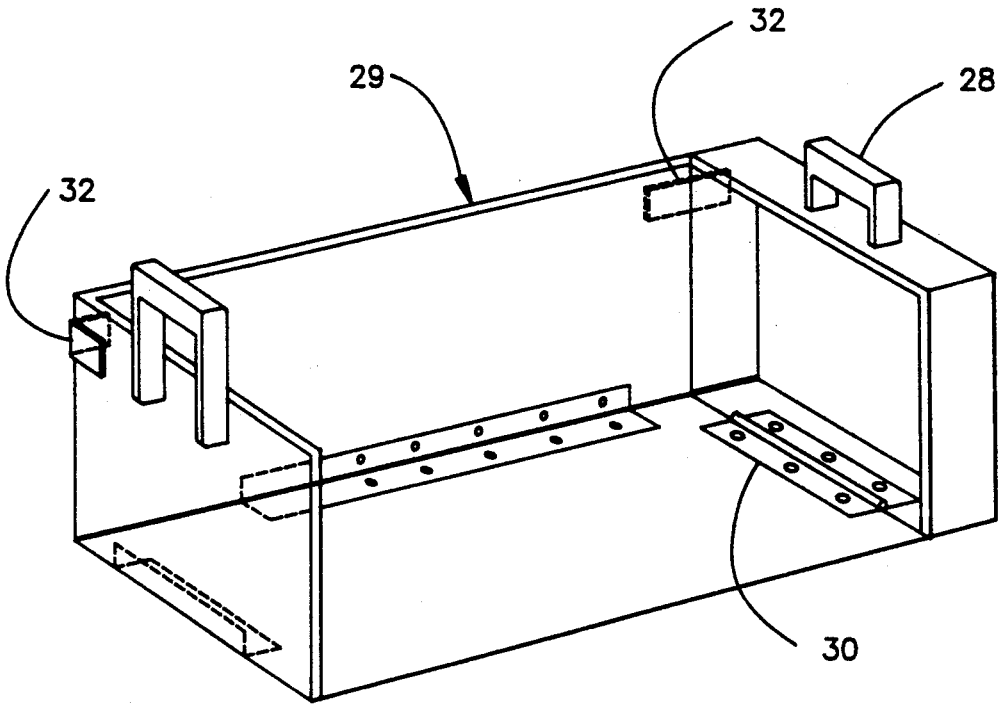
FIG. 2 shows a fold up box version.

| LIST OF REFERENCE NUMERALS | EMBODIMENT | FIG NO |
|---|---|---|
| 20 Box embodiment | Box embodiment | 1 |
| 22 Frame | Box embodiment | 1 |
| 24 First side | Box embodiment | 1 |
| 26 Vertical side structure | Box embodiment | 1 |
| 28 Handles | Box embodiment | 1 |

-continued

| LIST OF REFERENCE NUMERALS | EMBODIMENT | FIG NO |
|---|---|---|
| 29 Fold-up box embodiment | Fold-up box | 2 |
| 30 Hinges | Fold-up box | 2 |
| 32 Latches | Fold-up box | 2 |
| 34 Legs | Legs & frame | 3 |
| 36 Frame | Legs & frame | 3 |
| 37 First side of frame | Legs & frame | 3 |
| 38 Brackets | Legs & frame | 3 |
| 40 Legs | Canted frame | 4 |
| 42 Canted frame | Canted frame | 4 |
| 44 Frame | Stubby legs | 5, 5A |
| 46 Stubby legs | Stubby legs | 5, 5A |
| 48 Frame | Enhanced embodiment | 6 |
| 50 First side | Enhanced embodiment | 6 |
| 52 Side Structure | Enhanced embodiment | 6 |
| 54 Handle | Enhanced embodiment | 6 |
| 56 Entrance Lip | Enhanced embodiment | 6 |
| 58 Legs | Enhanced embodiment | 6 |
| 60 Brackets | Enhanced embodiment | 6 |
| 62 Plastic ties for legs | Enhanced embodiment | 6 |
| 64 Funnel segment | Enhanced embodiment | 6 |
| 65 Frame tabs | Enhanced embodiment | 6 |
| 68 Wheels | Enhanced embodiment | 6 |
| 70 Axle | Enhanced embodiment | 6 |
| 72 Sloping side structure | Enhanced embodiment | 6 |
| 74 Container | Preferred embod. | 7 |
| 76 Bottom | Preferred embod. | 7 |
| 78 Top | Preferred embod. | 7 |
| 80 First side | Preferred embod. | 7 |
| 82 Second side | Preferred embod. | 7 |
| 84 Third side | Preferred embod. | 7 |
| 86 Fourth side | Preferred embod. | 7 |
| 88 Legs | Preferred embod. | 7 |
| 89 Plastic ties | Preferred embod. | 7 |
| 90 First handle | Preferred embod. | 7 |
| 91 Frame | Preferred embod. | 7 |
| 92 Risers | Preferred embod. | 7 |
| 94 Entrance edge | Preferred embod. | 7 |
| 96 Anti-slip pin | Preferred embod. | 7 |
| 98 Handles near top of container | Preferred embod. | 7 |
| 100 Bag storage receptacle | Preferred embod. | 7, 8 |
| 102 Closeable lid for bag storage | Preferred embod. | 8 |
| 104 Cover | Preferred embod. | 9 |
| 106 Cutouts on cover for the legs | Preferred embod. | 9 |
| 107 Bag attachment hook | Preferred embod. | 7, 13, 14 |
| 108 Bag lined trash container | Preferred embod. | 7, 13 |
| 109 Top lip of container | Preferred embod. | 7, 13 |
| 110 Mounting holes, bag attachment | Preferred embod. | 7, 13, 14 |
| 112 Mounting surface | Preferred embod. | 7, 13, 14 |
| 114 Perforated bag | Air blower option | 10 |
| 116 Elastic tie cords | Air blower option | 12 |
| 120 Telescoping leg | Storable legs | 15 |
| 122 Storable leg | Storable legs | 15 |
| 124 Telescoping leg body | Storable legs | 15 |
| 126 Spring catch - storable leg | Storable legs | 15 |
| 127 Durable liner | Option | 16 |
| 131 Adapter for pre-existing trash container | Adapter | 17 |
| 132 Pre-existing trash container | Adapter | 17 |
| 133 First side | Adapter | 17 |
| 134 Second side | Adapter | 17 |
| 136 Hook | Adapter | 17 |
| 138 Handle | Adapter | 17 |
| 140 End view of flat bag | Theory | 18 |
| 142 Filled bag | Theory | 18 |

DETAILED DESCRIPTION OF THE INVENTION

Fasteners are included within the specification text and are shown pictorially in the drawings as a simple dot or a circle; however fasteners are not called out on the drawings in order to eliminate unnecessary clutter.

Figure 1:
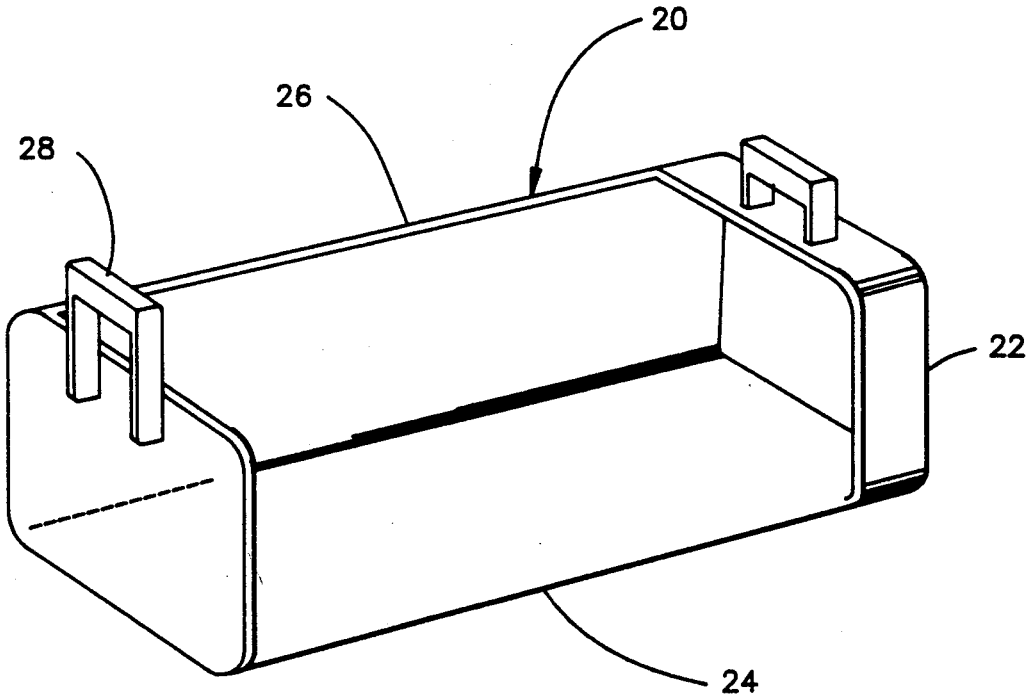
FIG. 1 shows the box embodiment of the invention.

FIG. 1 shows a box embodiment 20 with a frame 22, a first side 24, a vertical side structure 26, and a plurality of handles 28. The mouth of the bag fits around the frame 22 with the body of the bag external to the device. To use the device the first side 24 is set on the ground and the operator rakes debris into the bag and into the box 20 and then picks the device up with both handles 28 and dumps the debris from the box 20 into the bag.

FIG. 2 is a fold-up box embodiment 29 with a plurality of hinges 30 and a plurality of latches 32 to make a fold up version for compact storage.

Figure 3:
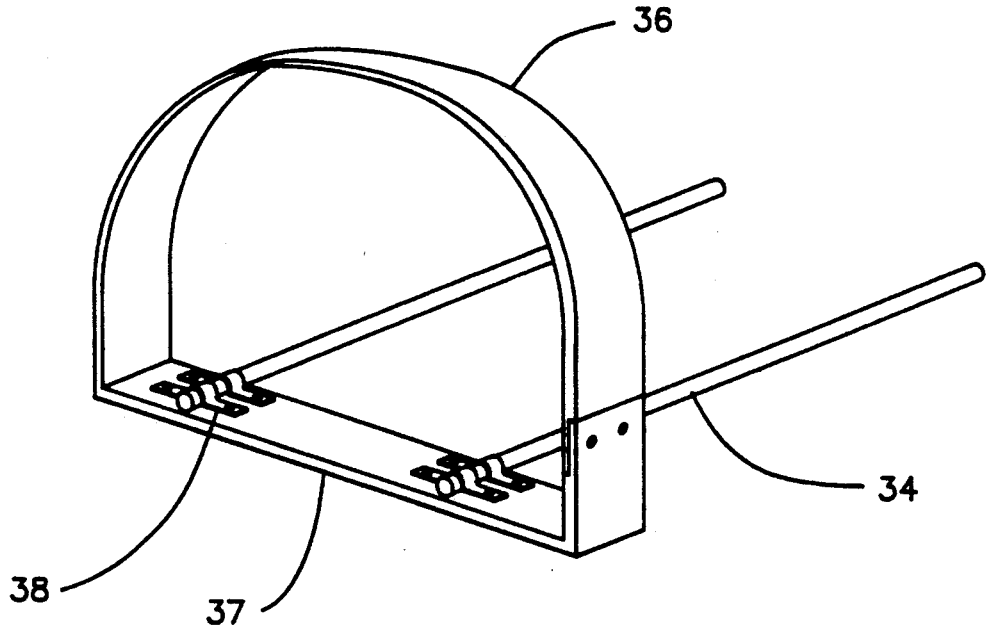
FIG. 3 shows the invention with legs.

FIG. 3 shows a simple embodiment of the invention. A frame 36 has a first side 37; the frame has a circumference approximately equal to the circumference of the mouth of the bag. A pair of legs 34 are attached to the frame 36 with a plurality of brackets 38 such that the legs 34 extend into the bag. The frame 36 is fabricated out of formed sheet metal and necessary fasteners.

Figure 4:
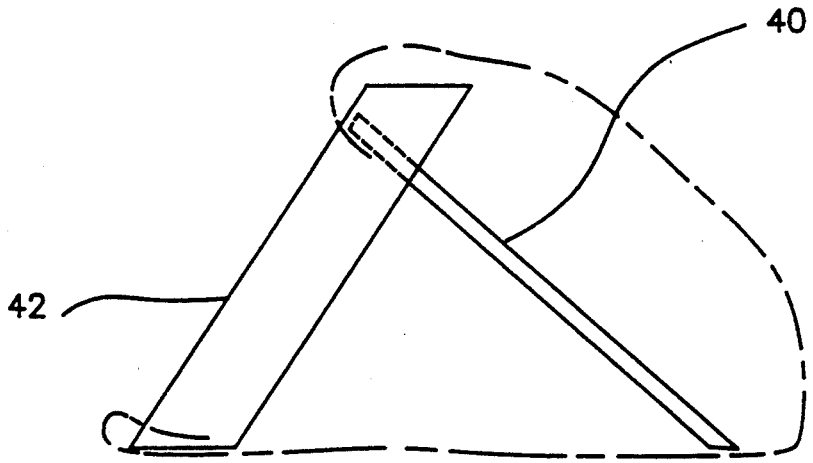
FIG. 4 shows a canted embodiment of the invention with legs.

A canted version of the invention of FIG. 3 is shown in FIG. 4 as a side view. A plurality of legs 40 prop up the canted frame 42 such that as debris is pushed into the bag the legs 40 tend to dig into the ground and prevent the device from slipping along the ground. The frame 42 is also tilted at approximately a 20 degree angle from the vertical which makes it more convenient to rake debris into the bag.

Figure 5:
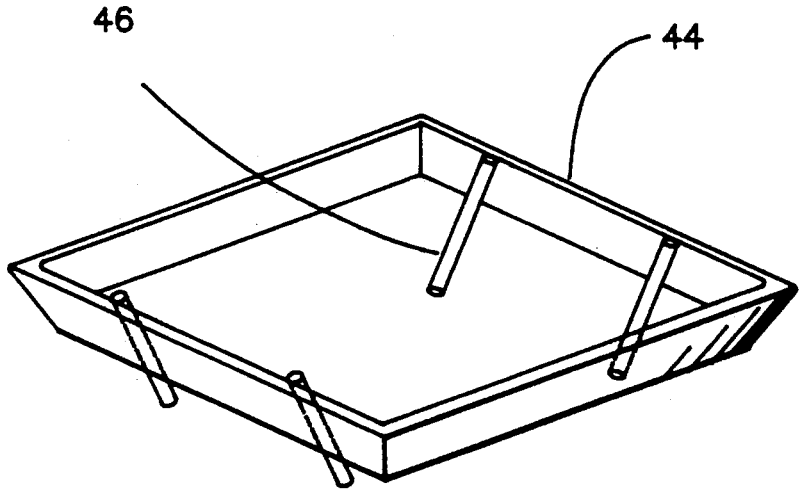
FIG. 5 shows the invention with stubby legs.

FIG. 5 has a frame 44 and a plurality of stubby legs 46 which are inclined slightly into the center of the frame 44.

Figure 5A:
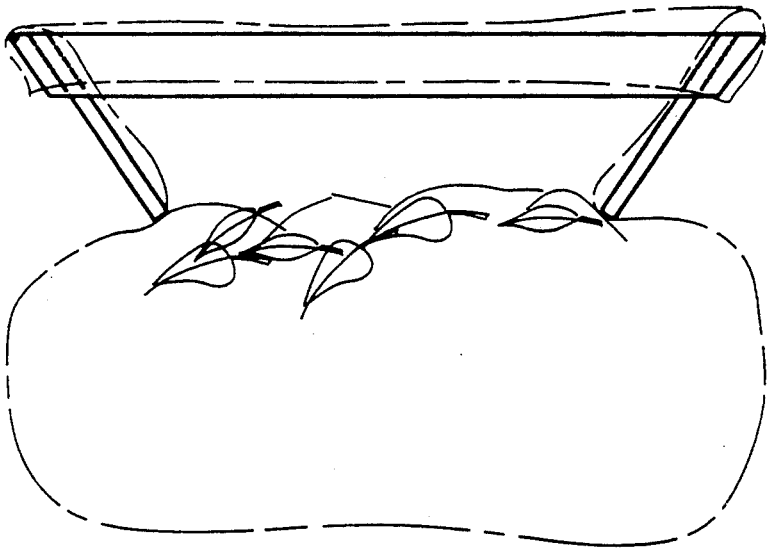
FIG. 5A shows the invention of FIG. 5 with debris in the bag.

FIG. 5A is a side view of the invention showing the stubby legs 46 resting on the debris in the bag, thus making room for more debris at the top of the bag.

Figure 6:
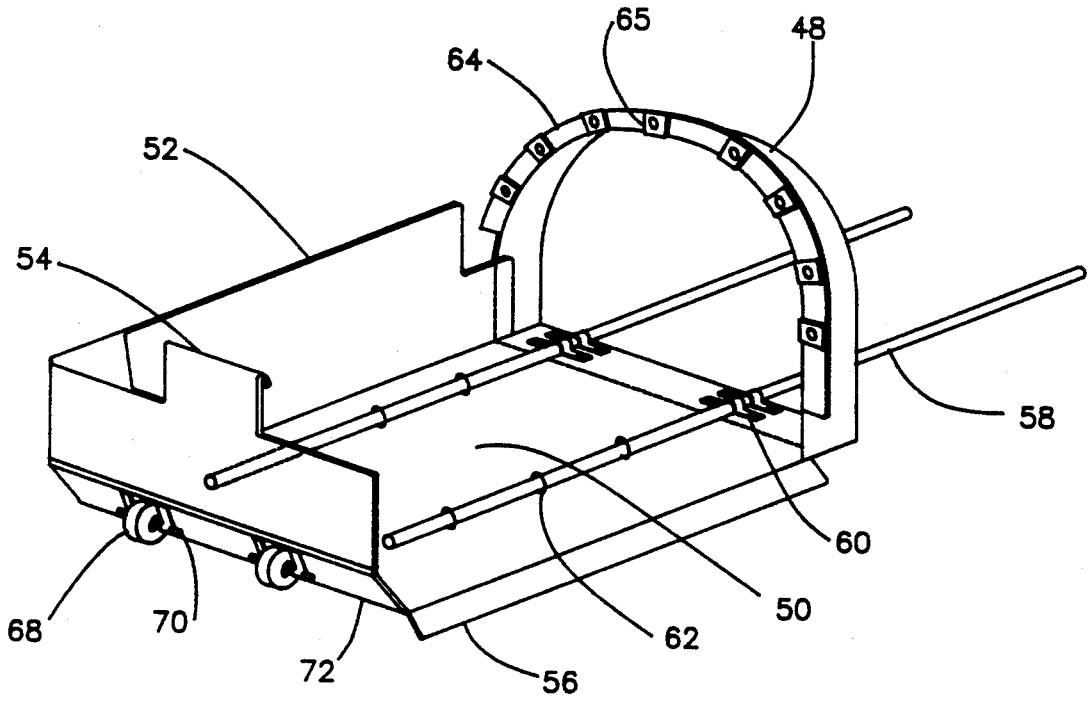
FIG. 6 shows an enhanced sheet metal version of the invention.

FIG. 6 shows an enhanced version of the invention. A frame 48 is made of formed sheet metal held together by fasteners. A first side 50, a vertical side structure 52, a handle 54, and an entrance lip 56 are formed out of one piece of sheet metal bent up like a cardboard box with appropriate fasteners. The first side 50 and the vertical side structure 52 overlaps the frame 48 and is attached with fasteners. A plurality of legs 58 extend internally the whole length of the first side 50 and thus contribute significantly to the rigidity of the device; the legs 58 support the device when it is upended. Although the legs 58 are shown as two separate supports, they could be replaced with a single planer support member. The legs 58 are attached to the frame 48 and to the first side 50 with a plurality of brackets 60 and a plurality of plastic ties 62.

A funnel segment 64 is attached to the frame 48 in order to funnel debris into the bag. The funnel segment 64 is 1.5 inches wide and is attached to the frame 48 with frame tabs 65 and fasteners. The funnel 64 extends at approximately a 30 degree angle from the surface of the frame 48.

A plurality of wheels 68 enable the device to be used as a cart to carry heavy debris. When used as a cart one of the legs 58 can act as a handle. Each wheel 68 rotates on an axle 70 which is attached to the sloping portion 72 of the side structure 52 with clevis pins and nuts.

DESCRIPTION OF THE PREFERRED EMBODIMENT

Figure 7:
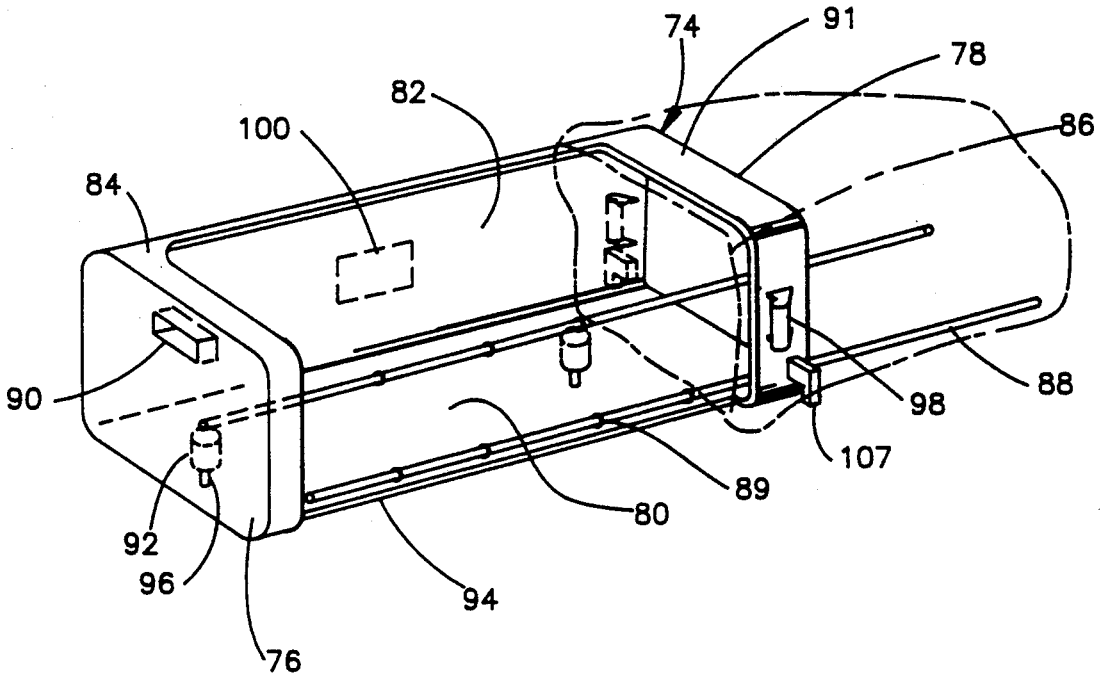
FIG. 7 shows the preferred embodiment.

FIG. 7 shows the preferred embodiment. A plastic rectangular trash container 74 which has a bottom 76 that it can stand on, an open top 78, a first side 80, a second side 82, a third side 84, and a fourth side 86. A plurality of legs 88 are attached to the first side 80 with a plurality of plastic ties 89. A first handle 90 is used to upend the container 74 on its legs 88.

Voids are cut into the first side 80, third side 84, and fourth side 86 as shown. The region of the container 74 extending around the whole perimeter and from the top 78 down to the void on the third side 84 is referred to as the frame 91.

A plurality of risers 92 are attached to the first side 80. With the container 74 resting on its first side 80 the risers 92 lift part of the first side 80 up off of the ground which causes an entrance edge 94 to rest on the ground. The risers 92 have a anti-slip pin 96 sticking out the underneath side which dig into the ground and prevents the device from slipping.

A plurality of handles 98 are located near the top 78 of the container 74.

Figure 8:
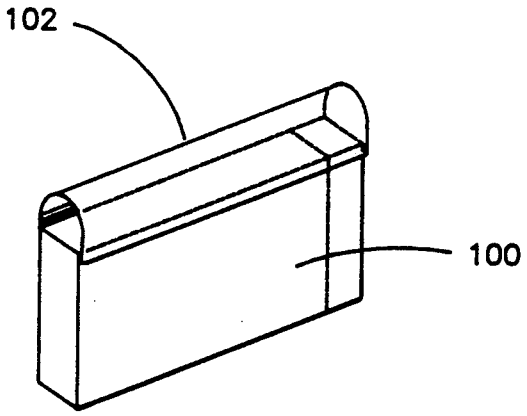
FIG. 8 shows a bag storage receptacle.

A bag storage receptacle 100 is attached to the container 74 so as to provide convenient access to bags and ties. See FIG. 8, the storage receptacle 100 has separate compartments for the bags and for ties and has a closable lid 102 which prevent the bags from spilling when the container 74 is upended.

Figure 9:
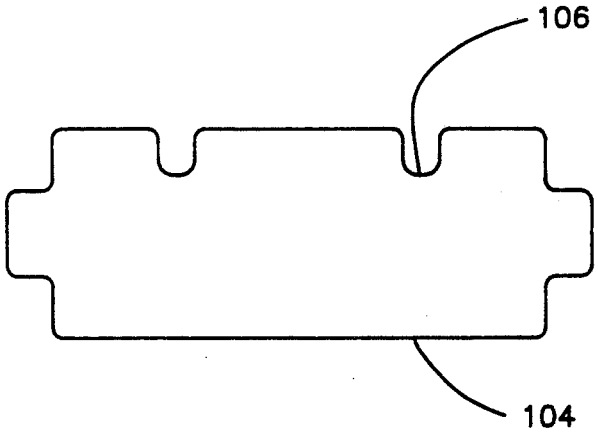
FIG. 9 shows an outline of a cover for trash container.

FIG. 9 shows a top outline view of a snap on cover 104 which fits over the top 78 and snaps onto the lip of the container 74. The cover 104 has cutouts 106 for the legs 88.

No detail is provided here for a bag receptacle 100, a cover 104, and handles 90 and 98, because all these items are examples of a well developed art with samples available from hardware and department stores.

Figure 10:
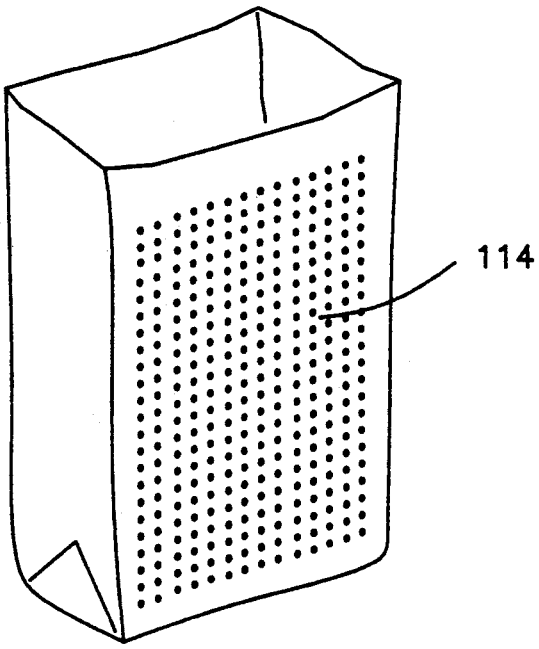
FIG. 10 shows a perforated bag to facilitate collecting debris with a blower.
Figure 11:
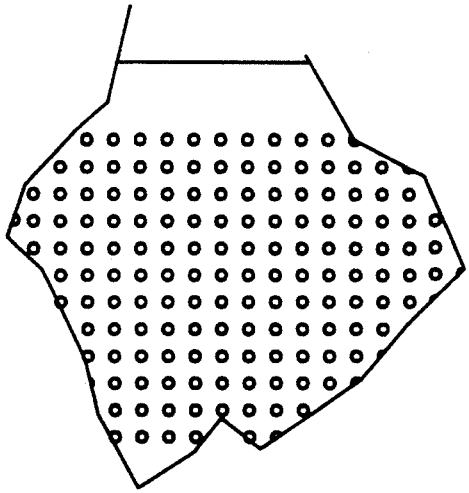
FIG. 11 shows the container hole pattern to facilitate collecting debris with a blower.
Figure 12:
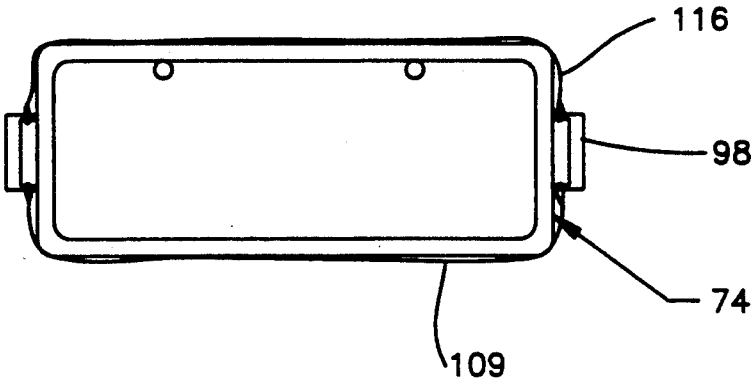
FIG. 12 shows elastic tie straps being used as a bag retainer.

FIG. 10 shows a perforated bag 114 which is used on the device of FIG. 7 when the debris is collected with a blower. FIG. 11 shows a hole pattern used on the surface of the container 74 to facilitate material collection with a blower. If a high powered blower is used it is necessary to secure the bag 114 onto the container 74 of FIG. 7. FIG. 12 shows a top view of the container 74 with a set of elastic tie cords 116 which retain the bag 114 on the container 74. The cords 116 are tied between the handles 98 and around the container 74 just below the container top lip 109. One end of each tie cord 116 is permanently connected to one of the handles 98 for ready availability.

Figure 13:
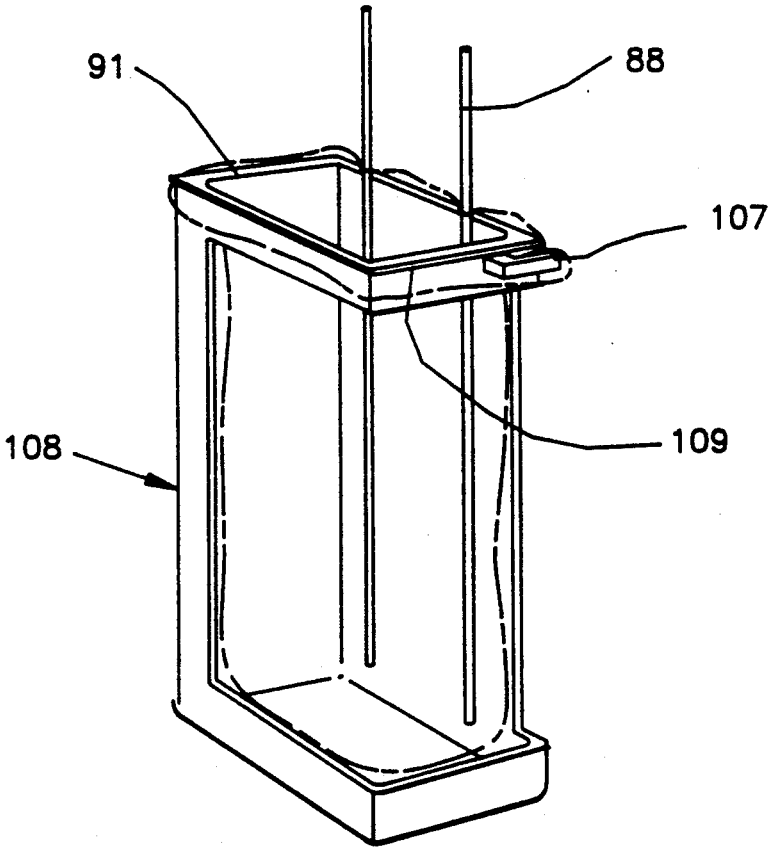
FIG. 13 shows the invention used as a trash container.
Figure 14:
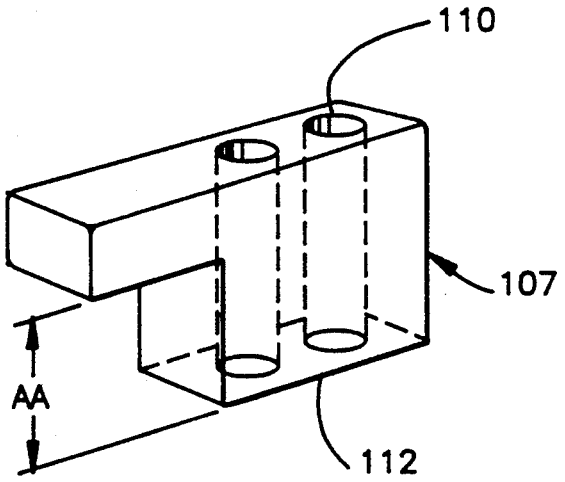
FIG. 14 shows a bag attachment hook.

A set of bag attachment hooks 107 (FIG. 7) is fastened to the second side 82 and the fourth side 86. The bag attachment hooks 107 enable the device to be used as a standard bag lined trash container 108 as shown in FIG. 13. The bag is held onto the frame 91 by looping the mouth of the bag around the hook 107 and then around the rest of the frame 91; except the bag can not loop around the first side 80 of the frame 91 because the legs 88 are in the way. See FIG. 14 for a hook design appropriate for a 33 gallon disposable plastic bag. Dimension AA is equal to the width of the lip 109 (looking down in FIG. 13) at the top of the trash container 108. The attachment hook 107 is mounted to the trash container 108 using mounting holes 110 such that surface 112 is the mounting surface. In FIG. 13, there is a clearance of ¼ inch between the nearest adjacent surfaces of the bag attachment hook 107 and the top cover 104 when the cover is put on the trash container 108. The cover of a standard trash container "seals" along the perimeter at the lip of the trash container. As shown in FIG. 13 in this device the hanging trash bag does not follow the lip 109 all the way around because the legs 88 are in the way. Therefore the cover 104 for this device is modified so that it "seals" (touches the bag) along the top perimeter of the bag.

Figure 15:
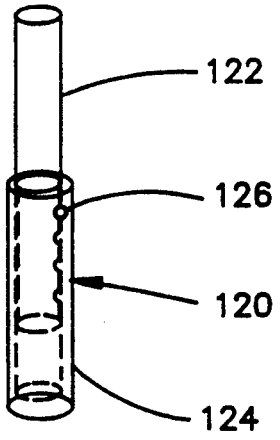
FIG. 15 shows a telescoping leg.

The bag attachment hooks 107 are used in the standard bag-lined trash container application 108 because the legs 88 prevent the bag from being fitted around the whole perimeter of the container 74 and the hooks 107 were needed to keep the bag from slipping off the frame 91. As an alternative to using bag hooks 107 the legs 88 can be replaced with telescoping legs 120 of the type shown in FIG. 15, consisting of a storable leg section 122 and a leg body 124 and a spring catch 126. When the storable leg 122 is retracted inside the leg body 124 it will no longer interfere with the bag; the bag mouth will fit all the way around the top of the container 74 and bag hooks 107 are no longer needed. The deployed leg 122 should be wiped clean before storing to prevent debris from getting inside the "telescope". No telescope detail is presented here because such construction is a well developed art.

Figure 16:
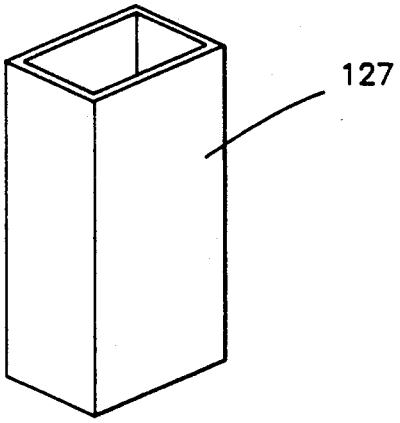
FIG. 16 shows a durable liner for the container.

FIG. 16 shows a removable durable internal liner 127 for the device of FIG. 13. In the application as a standard trash container 108, the durable liner 127 fits inside the trash container 108 and covers up the voids in the container surface and prevents small animals from tearing at the bag. The durable liner 127 can perform a second function as an additional, (bottomless) bag lined receptacle during yard clean up.

Figure 17:
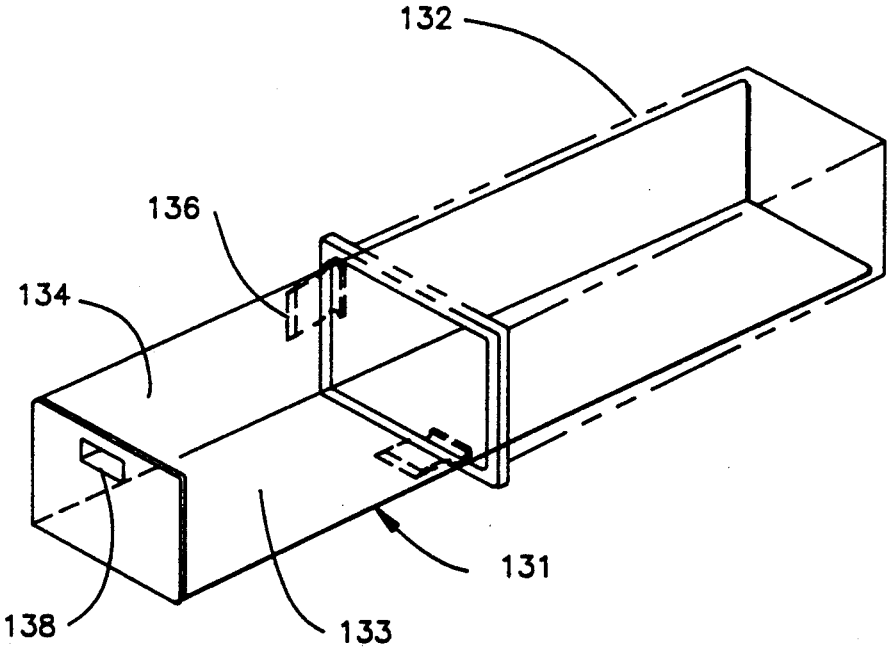
FIG. 17 shows an adapter for an existing trash container.

FIG. 17 shows an adapter 131 which is used to fill a pre-existing standard trash container 132 with debris from the ground. In this case the pre-existing trash container 132 may be either bag-lined or unlined. The adapter 131 has a first side 133 and a second side 134. The adapter 131 attaches to the trash container 132 by virtue of the fact that the sides extend to the bottom of the container 132 and because it has a plurality of hooks 136 which attach to the lip of the container 132. The adapter 131 can be easily attached and detached from the trash container 132. The sides extend into the container 132 only for purpose of attachment; the portion of the sides extending outside of the container 132 do the actual work of the invention. In operation the adapter 131 (with trash container attached) is laid with its first side 133 on the ground and debris is raked onto the first side 133 and into the container 132. When the desired amount of debris is in the container 132 and on the first side 133 the operator tilts the trash container 132 upright and the debris on the first side 133 slides into the container 132.

A handle 138 is used to upend the adapter 131 and trash container 132 combination so as to dump the contents of the adapter 131 into the existing trash container 132.

The adapter 131 of FIG. 5 can be augmented with the following enhancements as shown in FIGS. 6 and 7: entrance lip 56, risers 92, anti-slip pins 96, bag storage receptacle 100 and additional handles 98.

The adapter 131 of FIG. 5 can be made less expensive to fabricate by designing the adapter 131 and trash container 132 as mating parts. Being designed as mating parts the adapter 131 could snap onto the trash container 132 with a simple plastic snap latch which is built into the mold. As another option, the adapter 131 can be made a permanent integral part of a trash container. As a final alternative, the adapter 131 can be made a permanent part of the trash container but on slides to make it disappear into the container.

Right And Left Handedness: FIG. 7 show the legs 88 extending to the upper right and the side opening at the right; this configuration is called a left handed configuration because it is convenient for a left handed person to rake debris into the bag. The device can also be built in a right handed configuration (not shown) with the legs extending to the upper right and the side opening on the left side.

OPERATION OF THE DEVICES OF FIG. 3 AND FIG. 5

To load the bag onto the device of FIG. 3 the bag is pulled down over the legs 34 and over the frame 36 as far as it will go; the bag is longer than the device and the excess bag length is folded over the frame 36 and tucked back into itself. An operator rakes or otherwise loads debris into the bag. When the mouth of the bag becomes clogged with debris the operator grasps the top of the frame 36 and tilts the device up on its legs 34 thus dropping the debris into the bottom of the bag. The operator repeats the loading and tilting operation until the bag is filled.

In FIG. 5, with the legs resting on a horizontal surface the body of the bag is put through the frame and the mouth of the bag is folded back over the outside of the frame 44 (in this embodiment the legs are outside of the bag). This device is used by a kneeling or siting gardener; the legs 46 are stubby so the bag is conveniently low to the ground. When the debris in the bag builds up to the top of the frame 44 the gardener grasps the device with both hands and lifts it up, allowing material to fall into the bag; the operator then sets the device back down and the legs 46 rest on the debris in the bag (see FIG. 5A) thus elevating the frame 44 which provides space for additional debris.

OPERATION OF THE PREFERRED EMBODIMENT

Figure 7A:
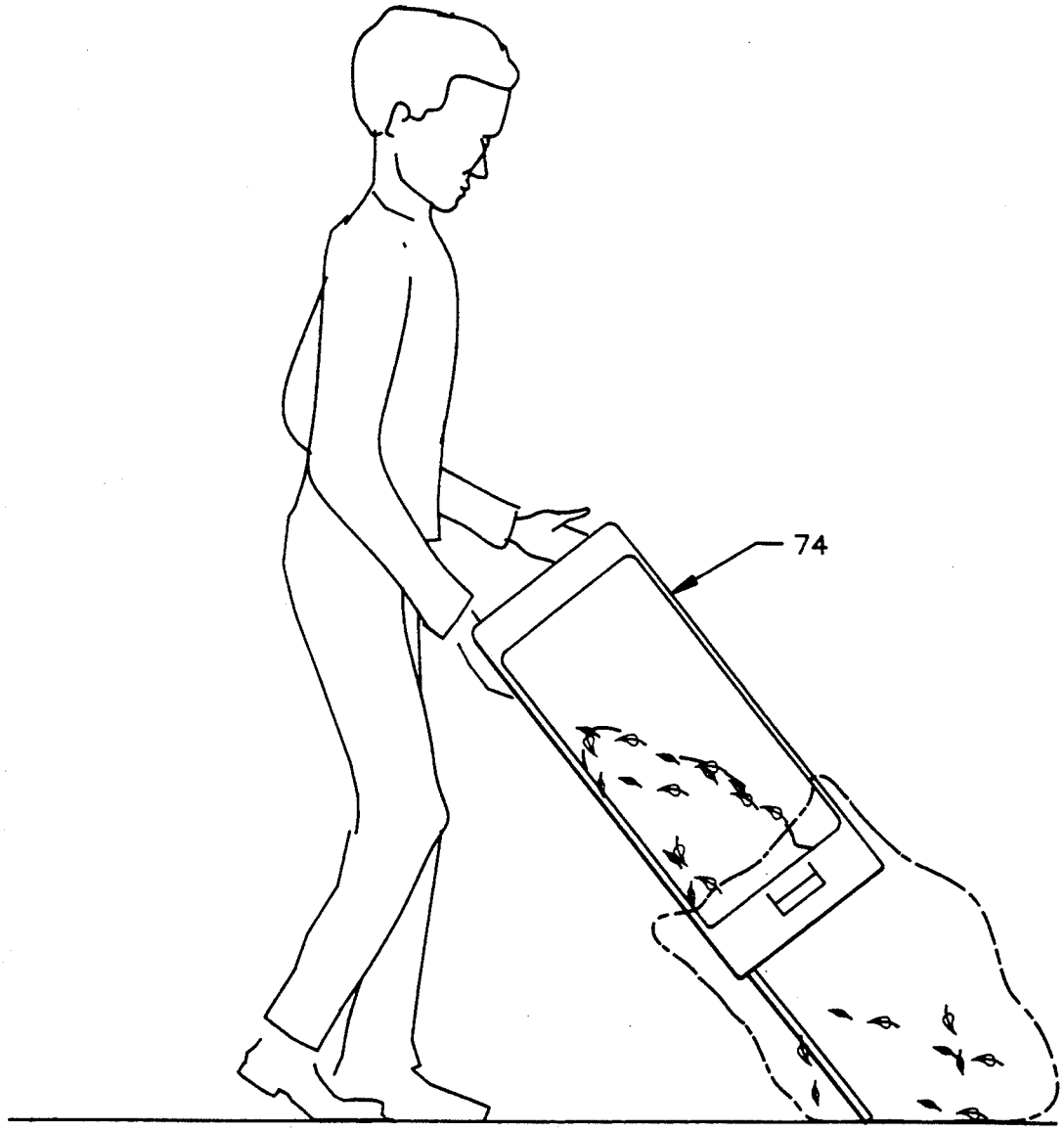
FIG. 7A shows debris sliding into the bag.

See FIG. 7. To use the preferred embodiment it is first stood up with the two legs 88 sticking up in the air. A bag is placed over the legs 88 and pulled down around the body of the container 74 and past the two handles 98 as far as it will reach conveniently. The device is then set down laying on its first side 80. The mouth of the bag is open and is now in a plane approximately perpendicular to the ground. The operator directs debris into the container 74 and also into the bag itself as part of the collection operation (using the means chosen by the operator—rake, broom etc) but no undue effort is made to fill the bag in the collection process. The operator can prevent the device from scooting along the ground as he is raking debris directly into the bag by putting his foot on the first side 80 near the bottom 76. When the desired amount of debris is in the bag and in the container 74 (see FIG. 7A) the operator tilts the device up so that the debris in the container 74 slides into the bag. When the device is tilted up approximately 90 degrees the mouth of the bag is in a horizontal plane at a height equal to the length of that portion of the legs 88 which stick out of the container 74. One hand can be used to tilt the device and the other hand used to guide and push the debris into the bag.

INTERFACE OF BAG TO THE INVENTION

The following discussion is based on the interface of a 33 gallon bag to the preferred embodiment, but the general principles are applicable for any size bag.

A standard 33 gallon trash bag has flat dimensions of 2 feet 9 inches at its opening and a depth of 3 feet 4 inches; the circumference of the mouth of the bag is twice the 2 feet 9 inch dimension (66 inches). The Circumference of the trash containers 74 used for prototypes was 67¾ inches at the top lip 109 and 67 inches around the handles 98. The bag circumference is the same, except for stretch, whether the bag is empty or full. However the quoted depth dimension of the flat bag looses significance when the bag is full because the width of a full bag subtracts from the flat depth dimension. The next paragraph shows a way of estimating the height of a full standing bag.

Figure 18:
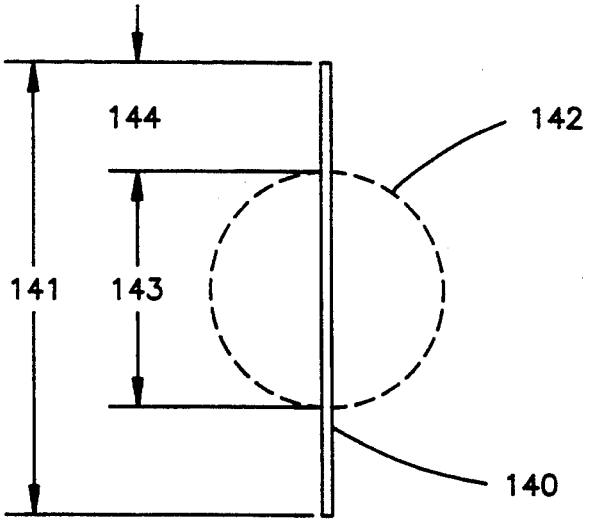
FIG. 18 shows an end view of the flat bag, empty and filled.

FIG. 18 shows an end view of a flat bag 140, and dotted lines show the approximate dimensions of a filled bag 142 which was determined by the following analysis. The published bag depth dimension of 3 feet 4 inches provides a total bag material length of 80 inches to enclose the debris and provide some length past the bag tie at the top of the bag 140. Assume that the bag tie at the top requires 3 inches of bag material existing beyond the tie; only 74 inches ($80-2\times3$) is left to hold the debris. Assume that the debris is in a sphere with a circumference equal to that 74 inches, the diameter of that sphere is equal to 23.5 inches. Thus the height of a full bag 142 up to the tie is approximately 23.5 inches.

Based on the above analysis the height of the leg section external to the container 74 plus the width of the frame 91 should be in the order of 23.5 inches. Prototypes built to that 23.5 inch dimension have worked well except that it was too easy to over-fill the bag (so you could not put a tie on it) and in multiple tilt operations the bag would prematurely come loose in about 10% of the bags. The 23.5 inch length was reduced to 21.5 inches and both those problems went away. The 21.5 inches was allocated to 4 inches for the frame 91 and 17.5 inches for the external leg section.

Legs 88 made of ⅝ inch diameter pine dowels were strong enough but the bag would get stuck on the tip of the leg 88 as the bag was pulled over the leg. When the leg tip diameter was increased to 1 inch and the tip was smooth and rounded the bag could be loaded onto the legs 88 without difficulty. If the tip diameter is made larger than the leg 88 diameter the transition from the narrow leg 88 to the wide tip should be tapered to reduce snagging on the debris when the legs 88 are withdrawn from the bag.

When the bag is pulled all the way down over the legs 88 and over the frame 91 there is excess bag material extending past the frame 91. This excess length which is folded over the frame 91 and tucked back into the bag serves a very useful purpose of helping to secure the bag to the device. As the debris is raked through the frame 91 and into the bag it rubs on the tucked portion of the bag and tends to keep the bag attached to the device.

FABRICATION ALTERNATIVES

The suggested fabrication process for the invention is the process used to make plastic garbage cans. There are many other options for choice of material and fabrication process. Some of these options are mentioned below. Details and figures for these options are not included because once mentioned, the approach is obvious and there is extensive existing art and technology for each of the approaches.

The container 74 body could be made out of sheet metal with two end caps.

The device could be made out of sheet metal folded up like a cardboard box as in FIG. 6.

The device could be made out of bent aluminum tubing and fabric using folding chair technology (in either a folding or non-folding version).

The legs 88 can be made of wood dowels, aluminum tubing, PVC pipe etc.

CONCLUSIONS

The advantageous of the various embodiments will now be compared to the current art.

Ross (U.S. Pat. No. 3,638,888) has an external frame which does not keep the body of the bag open and it is difficult to start feeding material into the bag because the sides of the bag tend to stick together. When the bag is stretched over the legs 88 and the frame 91 of FIG. 3 a wedge shaped volume is open and available to put debris into.

The device of FIG. 3 is simpler than the internal wire frame of Battle (U.S. Pat. No. 4,299,365); and the transverse components in the wire frame will tend to impede the withdrawal of the frame from the bag. It is not necessary to have an internal frame which mimics the square or cylindrical trash cans as in Battle, it is only necessary to separate the sides of the bag (as in the current invention) so that debris can enter the bag, then the bag just conforms to the shape of the debris.

In Harris (U.S. Pat. No. 4,757,966) there is a hoop (frame) and a ladder structure which holds the hoop horizontal; the operator moves the hoop up the ladder as the bag gets filled. FIG. 5 is a much simpler way of accomplishing the same result; short legs attached to the frame rest on the debris that is already in the bag, thus this device uses the debris as the ladder.

To my knowledge none of the prior art for trash bag filling uses an attached container external to the bag (as in FIGS. 1,6, and 7). This combination permits raking directly into the container, then the loaded debris is transferred to the bag in a single dump operation. The legs added to the container makes the debris transfer from the container into the bag a relatively easy one-handed operation.

Although several embodiments of the invention have been specifically described and shown, it is to be understood that this was for purposes of illustration only, and not for purposes of limitation, the scope of the invention being in accordance with the hereinafter-presented claims.

I claim:

1. An apparatus for loading a trash bag with debris from the ground, comprising:

a frame having a continuous, unbroken perimeter for holding the mouth of said trash bag in an open position;

a first side perpendicularly attached to said frame for accumulating debris to be loaded into said trash bag;

a side structure, having voids to allow the movement of debris onto said first side, perpendicularly attached to said first side for containing accumulated debris on said first side;

legs for supporting said trash bag, said legs attached to said frame and extending from said frame inside said trash bag in a direction away from said first side; and first handle means attached to said side structure at a point on said side structure farthest from said frame.

2. The invention as in claim 1, further comprising:

a bottom, perpendicularly attached to said first side and said side structure, distal from said frame.

3. The invention as in claim 2, wherein one molded part comprises said frame, said first side, said side structure and said bottom.

4. The invention of claim 2 further including:

bag attachment means;

connecting means to connect said bag attachment means to said frame.

5. The invention to claim 1 further including:

a plurality of hinges;

attachment means to connect said hinges at appropriate places on said first side, on said frame, and on said side structure so that the device will fold up in a compact space for storage.

6. An apparatus for loading a trash bag with debris from the ground, comprising:

(a) a single molded part comprising:

a frame having a continuous, unbroken perimeter for holding the mouth of said trash bag sufficiently wide open and in a suitable configuration to allow debris to easily enter said bag when swept to a tool;

a first side perpendicular to said frame for accumulating debris to be loaded into said trash bag;

a side structure, having voids to allow the movement of debris onto said first side, perpendicular to said first side for containing accumulated debris on said first side; and a bottom perpendicular to said first side and said side structure, distal from said frame;

(b) one or more legs for supporting said trash bag, said legs attached to said molded part such that they extend from said frame inside said trash bag in a direction away from said first side;

(c) a first handle means attached to said bottom;

(c) second handle means attached to said frame.

* * * * *